United States Patent [19]

Toncelli et al.

[11] Patent Number: 4,559,920

[45] Date of Patent: Dec. 24, 1985

[54] BLADE-CARRYING FRAME FOR MACHINES FOR CUTTING MARBLE, GRANITE AND HARD STONE

[75] Inventors: Marcello Toncelli, Bassano Del Grappa; Walter Cado', Castelfranco Veneto, both of Italy

[73] Assignee: Breton S.p.A., Castello Di Godego, Italy

[21] Appl. No.: 687,979

[22] Filed: Dec. 31, 1984

Related U.S. Application Data

[63] Continuation of Ser. No. 477,890, Mar. 23, 1983, abandoned.

[30] Foreign Application Priority Data

Apr. 23, 1982 [IT] Italy ..... 85556 A/82

[51] Int. Cl.[4] ..... B28D 1/06

[52] U.S. Cl. ..... 125/17

[58] Field of Search ..... 29/452; 125/17, 18

[56] References Cited

U.S. PATENT DOCUMENTS 3,889,699 6/1975 Ranieri ..... 125/17

FOREIGN PATENT DOCUMENTS 653099 10/1928 France ..... 125/17

467832 12/1951 Italy ..... 125/17

*Primary Examiner*—Harold D. Whitehead

*Attorney, Agent, or Firm*—Bucknam and Archer

[57] ABSTRACT

A pack of blades is held together by means of cross-members (15) and it may be extracted in block from one end (8) of the frame through the opening (9) after having removed the wedges (6) and the inserts (5) for the purpose of substituting blades which have become worn out and permitting the insertion of a new pack of blades suitably pre-arranged so as to reduce to a minimum the period of time during which the machine must remain idle.

2 Claims, 3 Drawing Figures

BLADE-CARRYING FRAME FOR MACHINES FOR CUTTING MARBLE, GRANITE AND HARD STONE

This is a continuation of application Ser. No. 477,890 filed Mar. 23, 1983 and now abandoned.

The present invention relates to blades to be used in machines for sawing marble, granite and hard stones. More specifically, the present invention relates to a frame for carrying the blades. A novel feature of the present invention is to permit the removal of the entire pack of blades carried by the frame for the purpose of permitting the substitution of the blades outside of the machine by means of a very rapid operation which may be carried out only by one operator with great ease, while the frame is in operation and to replace one pack of blades with another pack of blades.

It is known that in large size machines for sawing marble, granite or other hard stones to obtain slabs of constant thickness, one of the problems which presents itself unavoidably is the substitution of the blades when, as a result of the wear, the blades become worn out and this substitution requires a period of time of several hours during which the machine cannot be operated. For this reason, it becomes necessary to slow up and dismount the worn-out blades one by one and rest them on the plane of the carrier which is used to support the block of the material being sawed, and then consequently, the latter is removed from the frame to permit the removal of the worn-out blades and the installation of the new blades. When the carrier is installed in the machine, it is necessary to mount the blades on the frame one by one, line them up and place them in operative position. All these operations require the work of three operators for a period of several hours, specifically between five and eight hours depending upon the type of frame and the number of blades which must be substituted.

Obviously, during this period of time, the machine remains idle with the substantial economical drawback of the increase on the overall cost of the operation.

An object of the present invention is to permit the extraction of the entire pack of blades from the machine and the substitution with a second pack of new blades so as to reduce to a minimum the period of time the machine is idle and reduce also substantially the required manpower in order to carry out the entire operation. Indeed, with a suitable installation, only one individual by himself may carry out the entire operation.

The invention will now be illustrated in more detail with reference to the accompanying drawings, of which:

Figure 1:
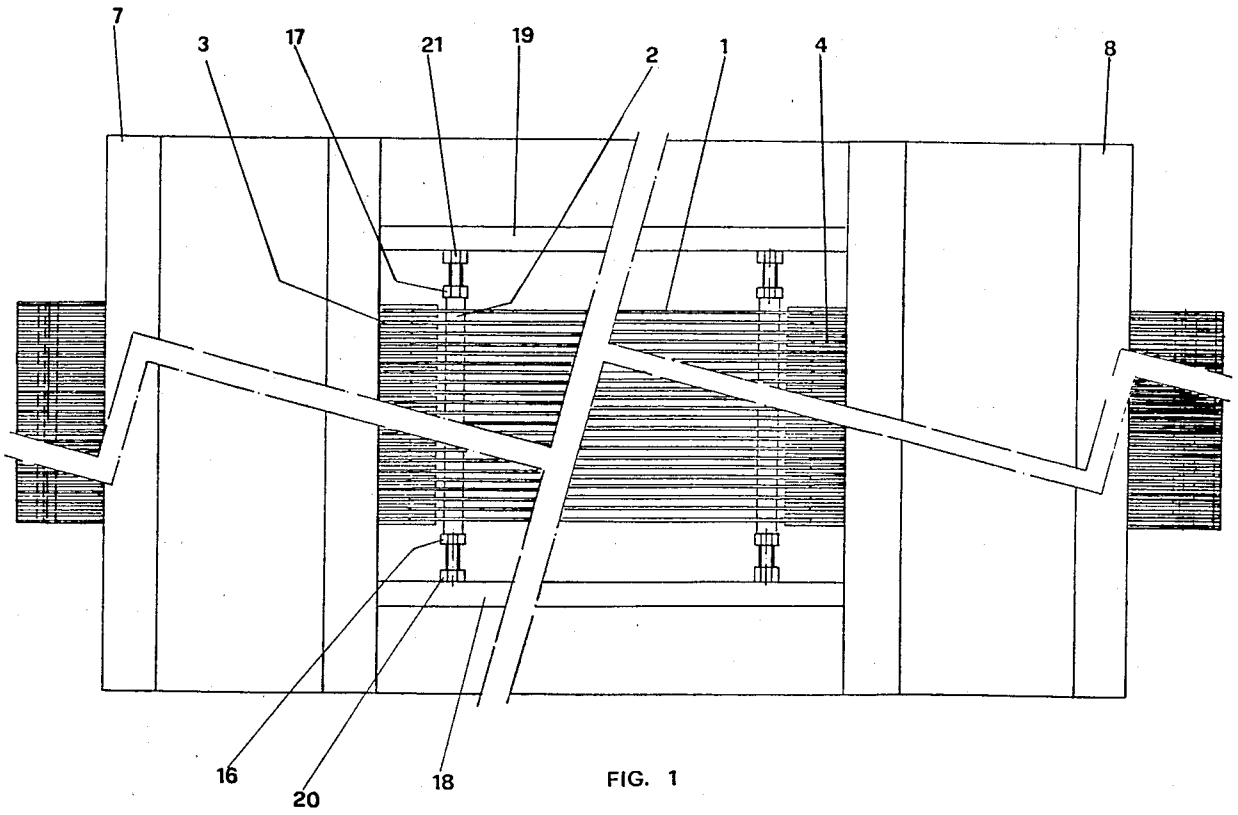
FIG. 1 is a plan view of the overall frame for the blades according to the present invention.
Figure 2:
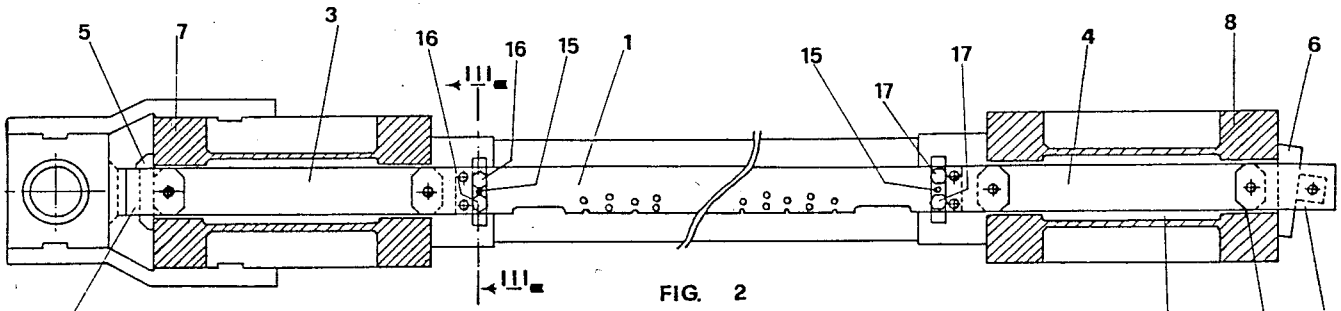
FIG. 2 is a side view of the frame.

As it is shown in FIGS. 1 and 2, the blades designated by numeral 1 are packed together with the interposition on each face of shims 2.

Each blade 1 is held on each face by tie rods 3 and 4 which are provided at one end with inserts 5 having parallel sides and at the other end with inserts 6 which have a wedge shape and which hold the blades hooked to the heads 7 and 8 of the frame.

The latter are provided with openings 9 and 10 of sufficient height to permit the passage of the blade 1 so that the entire pack of blades with the respective spacers and tie rods 3 and 4 connected among themselves by brackets 11 and 12 may be removed from the supporting frame through the head 8 and be carried onto a support plane having rollers placed in front of the frame where the substitution of the worn-out blades may be conveniently carried out.

During this operation, a new pack of blades suitably arranged may be inserted within the frame of the machine through the head 8 and may be, therefore, placed in tension by means of the wedges 6 so as to reduce to a minimum the period of time the machine remains inoperative.

Figure 3:
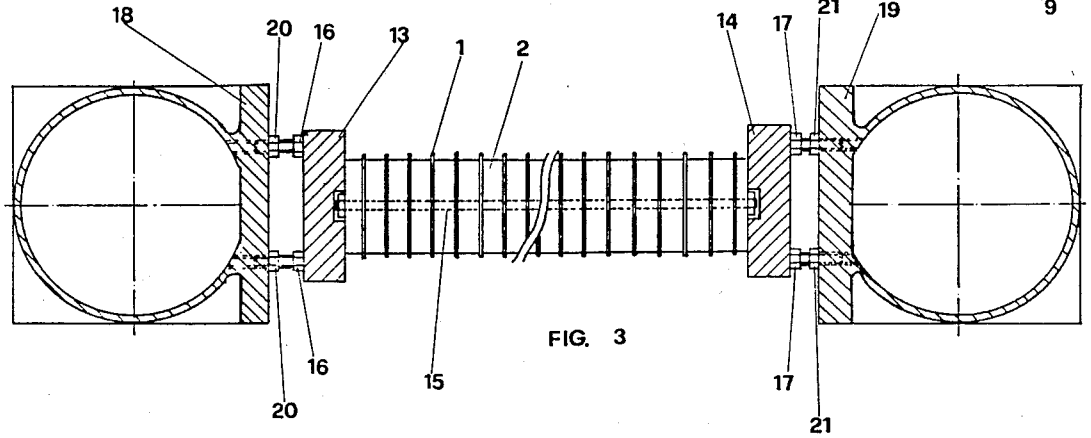
FIG. 3 is a cross-section along lines III of FIG. 2.

As shown in FIG. 3, the pack of blades 1 and respective spacers 2 is held laterally in position by plates 13 and 14, among which are arranged the threaded tie rods 15 which serve the only purpose of holding the pack of blades during the mounting stage. In fact, the pack, after it has been mounted on the frame, is compressed by adjusting screws 16 on one side and 17 on the other, which screws 16 and 17 are screwed respectively onto the side cross-members 18 and 19 of the frame where they are fixed by means of lock nuts 20 and 21.

The advantages according to the present invention are manifest because by means of the blade-carrying frame, it is possible to reduce to a minimum the period of interruptions of operation of the machine to provide for the changes of the blades and obviously to increase substantially the overall productivity of the machine itself.

Naturally, the details of construction of the frame of the invention which have been described in detail and illustrated in the accompanying drawings are only one specific embodiment of the invention provided by way of illustration, and clearly several changes may be made while keeping the essential characteristics of the invention unchanged.

What is claimed is:

1. A blade-carrying frame with a pack of blades which may be removed in block from the frame which is mounted in a machine used for sawing marble, granite, hard stones and the like, said pack comprising a plurality of blades (1), a plurality of spacer elements (2) interposed between adjacent blades, tie rods (3) and (4) connected to respective ends of said plurality of blades (1), said tie rods (3) and (4) also being respectively connected to heads (7) and (8) of said frame, a plurality of wedge-shaped inserts (6) connected to said tie rod (4) which function to hold the blades under tension against the head (8) of the frame, said heads (7) and (8) having respective openings (9) and (10) for receiving said tie rods, said openings being unobstructed upon removal of said inserts and being of sufficient size whereby the entire pack of blades may be non-destructively removed in one piece from the frame through the head (8) opening and a new pack of blades inserted in its place through said opening.

2. The blade-carrying frame according to claim 1, further comprising one or more cross-members (15) extending transversely through the pack of blades (1) and spacers (2) and functioning to hold the pack together when it is removed from the frame.

* * * * *